US012286796B2

(12) United States Patent
Shen

(10) Patent No.: US 12,286,796 B2
(45) Date of Patent: Apr. 29, 2025

(54) BUILDING PANEL SYSTEM

(71) Applicant: Chih-Sun Shen, Taichung (TW)

(72) Inventor: Chih-Sun Shen, Taichung (TW)

( * ) Notice: Subject to any disclaimer, the term of this patent is extended or adjusted under 35 U.S.C. 154(b) by 325 days.

(21) Appl. No.: 18/171,861

(22) Filed: Feb. 21, 2023

(65) Prior Publication Data

US 2024/0200340 A1 Jun. 20, 2024

(30) Foreign Application Priority Data

Dec. 19, 2022 (TW) ..... 111148758

(51) Int. Cl.

| | |
|---|---|
| ***E04F 13/08*** | (2006.01) |
| ***E04F 13/00*** | (2006.01) |
| ***E04F 17/04*** | (2006.01) |

(52) U.S. Cl.

CPC ..... *E04F 13/083* (2013.01); *E04F 13/007* (2013.01); *E04F 13/0805* (2013.01); *E04F 17/04* (2013.01); *E04F 2290/04* (2013.01)

(58) Field of Classification Search

CPC ... E04F 13/083; E04F 13/007; E04F 13/0805; E04F 17/04; E04F 2290/04

See application file for complete search history.

(56) References Cited

U.S. PATENT DOCUMENTS

| | | | | |
|---|---|---|---|---|
| 8,365,481 | B2 * | 2/2013 | Scully | E04F 13/0805 52/489.1 |
| 2010/0325997 | A1 * | 12/2010 | Scully | E04F 13/0805 52/489.1 |
| 2024/0044146 | A1 * | 2/2024 | Grosswirth | E04F 13/0816 |

FOREIGN PATENT DOCUMENTS

| | | | |
|---|---|---|---|
| CN | 101603361 A | | 12/2009 |
| CN | 100585108 C | * | 1/2010 |
| CN | 204753889 U | | 11/2015 |

OTHER PUBLICATIONS

A Search Report appended to an Office Action, which was issued to Taiwanese counterpart application No. 111148758 by the TIPO on Feb. 3, 2023, with an English translation thereof.

* cited by examiner

*Primary Examiner* — Rodney Mintz
(74) *Attorney, Agent, or Firm* — Burris Law, PLLC

(57) ABSTRACT

A building panel system include vertical members and horizontal members mounted to the vertical member, and a plurality of panel modules. Each of the panel modules includes a building panel, and a hanging member that is connected to the building panel and that is hung on a corresponding one of the vertical members and the horizontal members. The building panels of the panel modules cooperatively form a panel wall that is adapted to be spaced apart from a wall so that an air flow channel is formed between the panel wall and the wall and is adapted to communicate with an external space for air flowing.

9 Claims, 8 Drawing Sheets

BUILDING PANEL SYSTEM

CROSS-REFERENCE TO RELATED APPLICATION

This application claims priority to Taiwanese Patent Application No. 111148758, filed on Dec. 19, 2022.

FIELD

The disclosure relates to a panel system, and more particularly to a building panel system.

BACKGROUND

In recent years, with rapid economic development and populations aggregated in cities, buildings have been increased largely in number, thereby causing green spaces in the cities to decline. Furthermore, gas emissions from commercial activities and vehicles cause the phenomenon of urban heat island. Since reinforced concrete materials are commonly used in modern buildings, solar radiation tends to accumulate on outer walls and roofs of the buildings during daytime and is released at night, causing temperature of the urban environment to increase and exacerbating the phenomenon of urban heat island.

SUMMARY

Therefore, an object of the disclosure is to provide a building panel system that can reduce heat energy stored in a building outer wall.

According to the disclosure, a building panel system is adapted for mounting to a wall, and includes a plurality of vertical members, a plurality of horizontal members, and a plurality of panel modules.

The vertical members are spaced apart from each other in a left-right direction, and extend in a top-bottom direction perpendicular to the left-right direction.

The horizontal members are spaced apart from each other in the top-bottom direction, are mounted to the vertical members, and extend in the left-right direction.

Each of the panel modules includes a building panel, and at least one hanging member that is connected to the building panel and that is hung on a corresponding one of the vertical members and the horizontal members.

The building panels of the panel modules cooperatively form a panel wall that is adapted to be spaced apart from the wall so that an air flow channel is formed between the panel wall and the wall and is adapted to communicate with an external space for air flowing.

BRIEF DESCRIPTION OF THE DRAWINGS

Other features and advantages of the disclosure will become apparent in the following detailed description of the embodiment (s) with reference to the accompanying drawings. It is noted that various features may not be drawn to scale.

DETAILED DESCRIPTION

Figure 1:
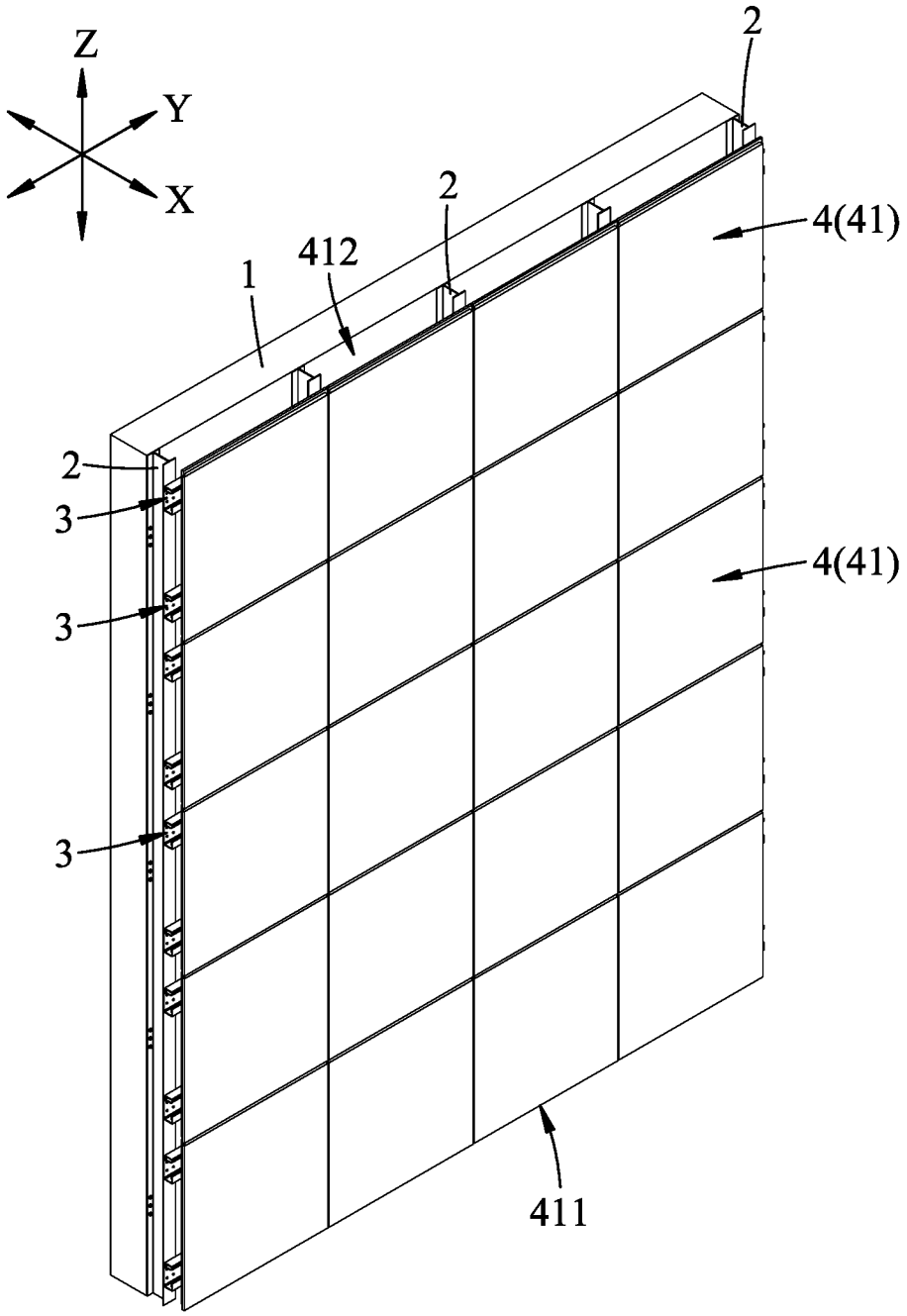
FIG. 1 is a perspective view illustrating a building panel system according to an embodiment of the disclosure for mounting to a wall.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
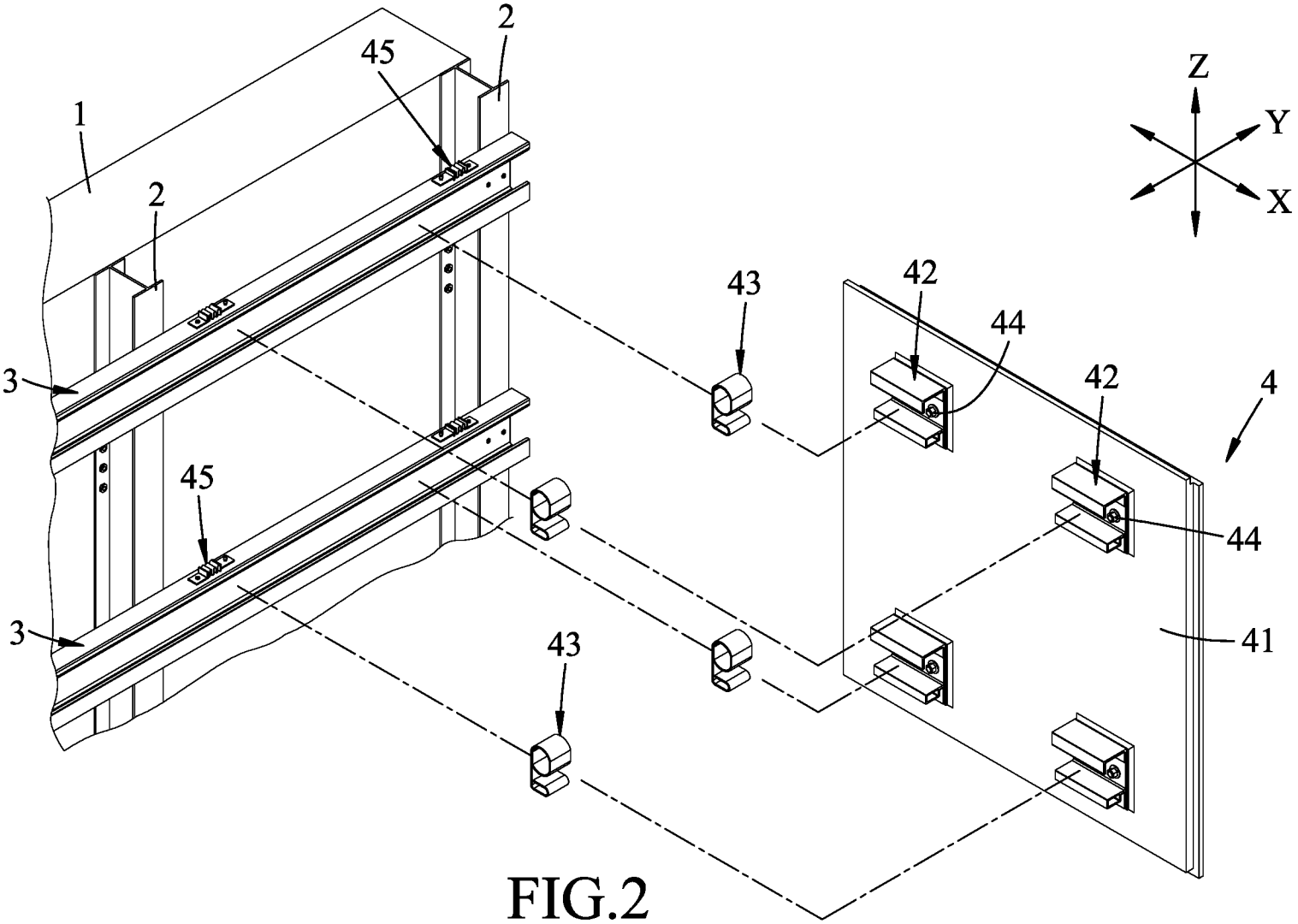
FIG. 2 is a fragmentary perspective view of the embodiment.

FIGS. 1 and 2 illustrate a building panel system according to an embodiment of the disclosure. The building panel system is suitable for mounting to a wall 1 of a building (not shown), and includes a plurality of vertical members 2, a plurality of horizontal members 3, and a plurality of panel modules 4.

The vertical members 2 are mounted to the wall 1, are spaced apart from each other in a left-right direction (Y), and extend in a top-bottom direction (Z) perpendicular to the left-right direction (Y).

Figure 3:
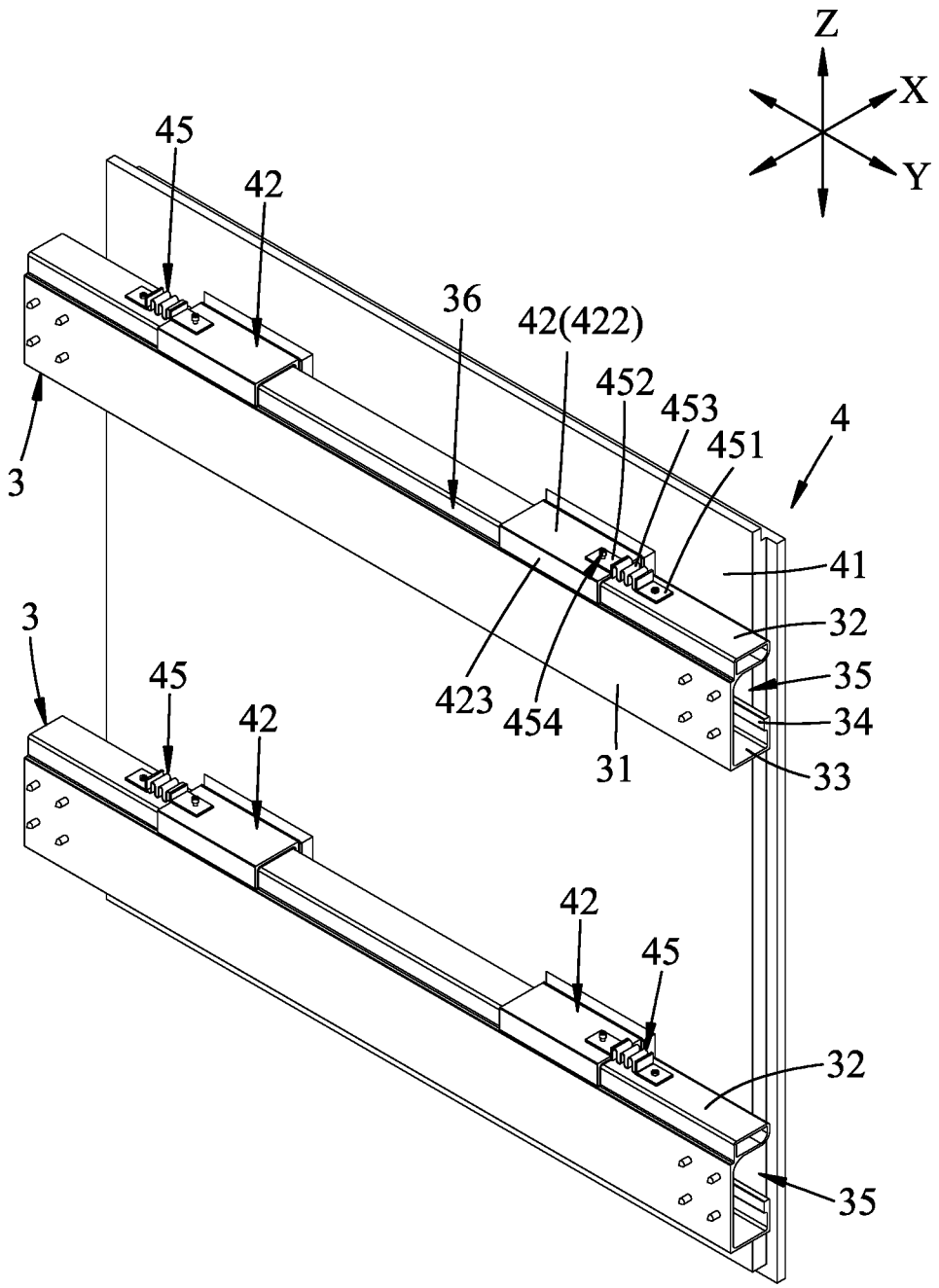
FIG. 3 is a fragmentary perspective view of the embodiment, illustrating the building panel system in an assembled state.
Figure 4:
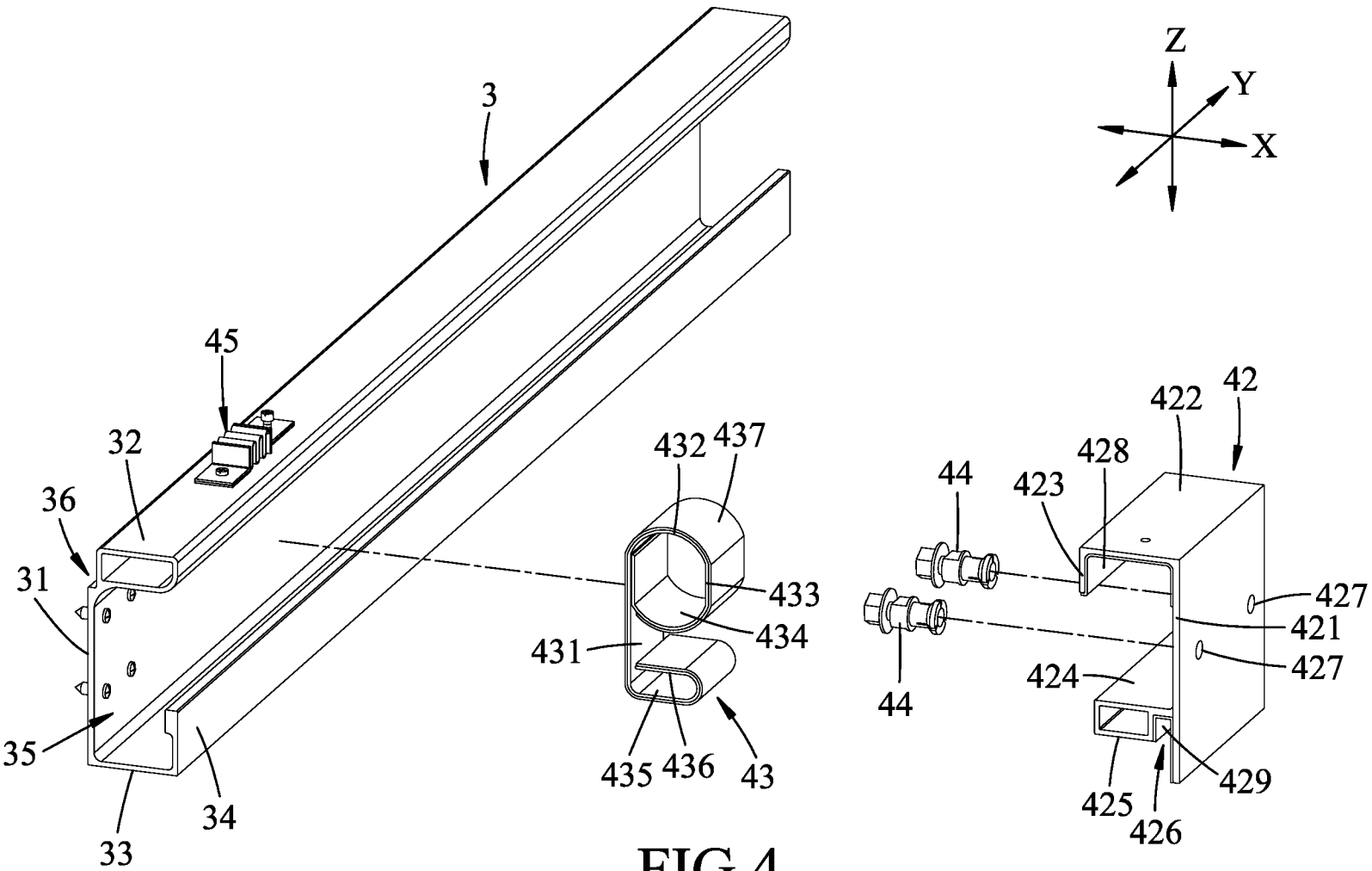
FIG. 4 is an exploded perspective schematic view of the embodiment, illustrating a hanging member, a resilient member, a buffer member, and a horizontal member of the building panel system.

Referring to FIGS. 3 and 4 in combination with FIG. 2, the horizontal members 3 are spaced apart from each other in the top-bottom direction (Z), are mounted to the vertical members 2 opposite to the wall 1, and extend in the left-right direction (Y). Each of the horizontal members 3 includes a rear base plate 31, a top protrusion 32, a bottom plate 33, and a front blocking plate 34, all of which are made of aluminum alloy. The rear base plate 31 fixedly abuts against the vertical members 2 opposite to the wall 1. The top protrusion 32 protrudes from a top end of the rear base plate 31 in a front-rear direction (X) perpendicular to the left-right and top-bottom directions (Y, Z), and is spaced apart from and disposed forwardly of the vertical members 2. The bottom plate 33 extends forwardly from a bottom end of the rear base plate 31 in the front-rear direction (X). The front blocking plate 34 extends upwardly from an end of the bottom plate 33 opposite to the rear base plate 31. For each of the horizontal members 3, the rear base plate 31, the top protrusion 32, the bottom plate 33, and the front blocking plate 34 cooperatively define a receiving space 35 that opens forwardly.

Figure 5:
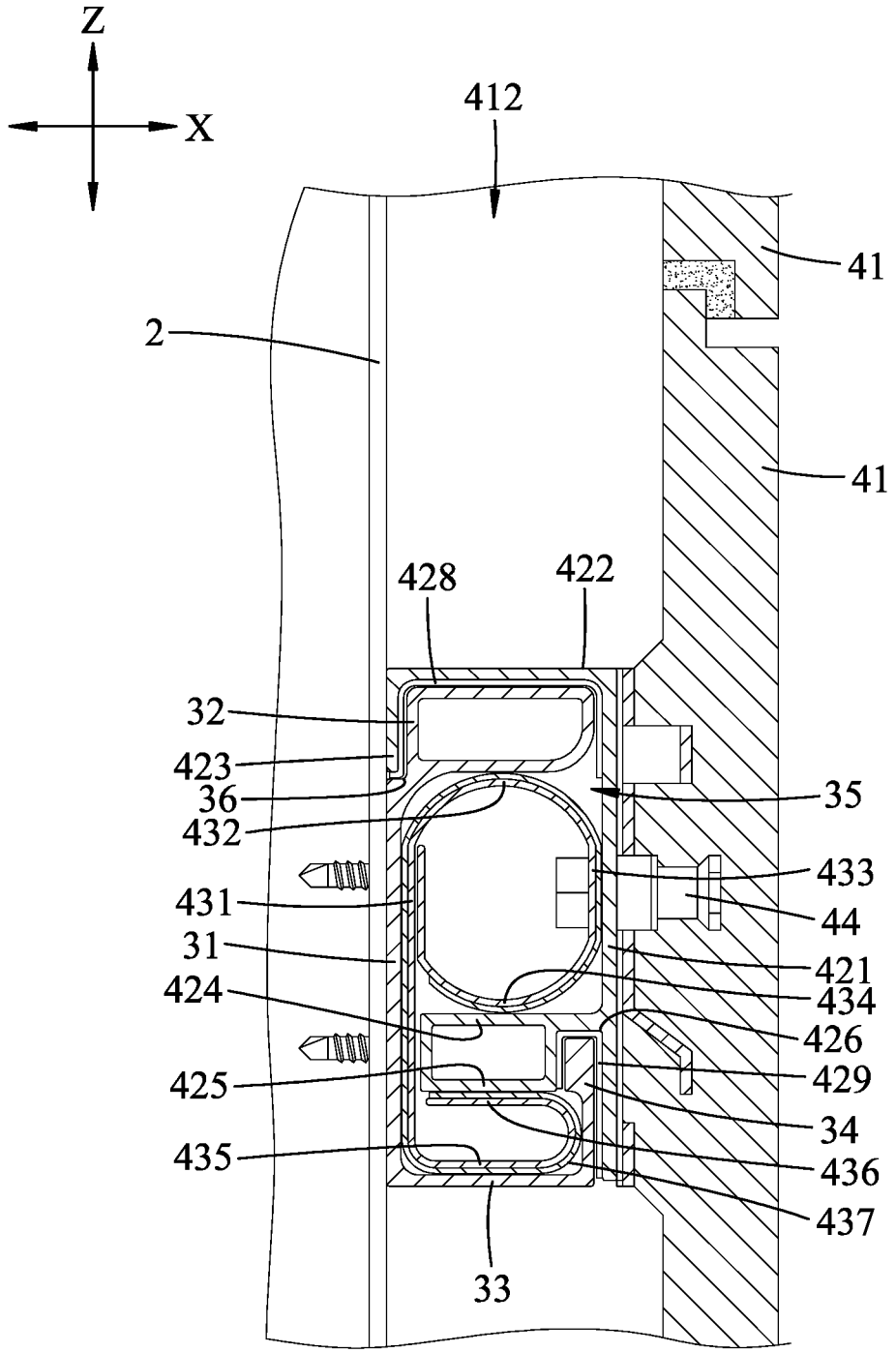
FIG. 5 is an enlarged fragmentary section side view of the embodiment, illustrating the building panel system in the assembled state.

Referring to FIGS. 4 and 5, the top protrusion 32 and the rear base plate 31 cooperatively define a positioning recess 36 therebetween; the positioning recess 36 opens rearwardly.

Referring to FIGS. 3 to 5, each of the panel modules 4 includes a building panel 41, four hanging members 42, four resilient members 43, a plurality of fastener members 44, and four buffer members 45.

For each of the panel modules 4, the hanging members 42 are spaced apart from each other in the left-right and top-bottom directions (Y, Z), and are connected to the building panel 41. Each of the hanging members 42 is hung on a corresponding one of the horizontal members 3, and includes a front base plate 421, a top plate 422, an insertion plate 423, a partition plate 424, and a bottom protrusion 425, all of which are made of aluminum alloy. The front base plate 421 is connected to the building panel 41, abuts against the top protrusion 32 and the front blocking plate 34 of the corresponding one of the horizontal members 3, and is formed with two through holes 427 that are spaced apart from each other in the left-right direction (Y) and that extend through the front base plate 421 in the front-rear direction (X). The top plate 422 extends rearwardly from a top end of the front base plate 421 and is disposed above and adjacent to the top protrusion 32 of the corresponding one of the horizontal members 3. The insertion plate 423 extends downwardly from an end of the top plate 422 opposite to the front base plate 421 and is engaged with the positioning recess 36 of the corresponding one of the horizontal members 3. The partition plate 424 extends rearwardly from the front base plate 421 and extends into the receiving space 35 of the corresponding one of the horizontal members 3. The bottom protrusion 425 extends downwardly from the partition plate 424 and is spaced apart from the front base plate 421. The partition plate 424, the bottom protrusion 425, and the front base plate 421 cooperatively define an engaging recess 426 that opens downwardly and that is engaged with the front blocking plate 34 of the corresponding one of the horizontal members 3.

Referring to FIGS. 2, 4 and 5, for each of the panel modules 4, each of the resilient members 43 is coupled to a respective one of the hanging members 42 and is received in the receiving space 35 of the corresponding one of the horizontal members 3. Each of the resilient members 43 has a rear support portion 431, a top abutting portion 432, a front support portion 433, a first abutting arm portion 434, a bottom abutting portion 435, and a second abutting arm portion 436. The rear support portion 431 abuts against the rear base plate 31 of the corresponding one of the horizontal members 3. The top abutting portion 432 is in connected to a top of the rear support portion 431 and resiliently abuts against the top protrusion 32 of the corresponding one of the horizontal members 3. The front support portion 433 is connected to the top abutting portion 432 and resiliently abuts against the front base plate 421 of the respective one of the hanging members 42. The first abutting arm portion 434 is connected to the front support portion 433 and resiliently abuts against the partition plate 424 of the respective one of the hanging members 42. The bottom abutting portion 435 is connected to a bottom end of the rear support portion 431 and resiliently abuts against the bottom plate 33 of the corresponding one of the horizontal members 3. The second abutting arm portion 436 is connected to the bottom abutting portion 435 and resiliently abuts against the bottom protrusion 425 of the respective one of the hanging members 42.

It should be noted that each of the hanging members 42 further has a rubber pad 428 that adheres to the insertion plate 423, the top plate 422 and a portion of the front base plate 421 and that faces toward a respective one of the resilient members 43, and a rubber pad 429 that is disposed in the engaging recess 426 and that is engaged with the front blocking plate 34 of the corresponding one of the horizontal members 3. The rubber pads 428, 429 provide anti-slip functions when each of the hanging members 42 is hung on the corresponding one of the horizontal members 3. In this embodiment, each of the resilient members 43 further has a rubber pad 437 that covers the rear support portion 431, the top abutting portion 432, the front support portion 433, the first abutting arm portion 434, the bottom abutting portion 435, and the second abutting arm portion 436. The rubber pad 437 of each of the resilient member 43 provides an anti-slip function to prevent each of the resilient members 43 from sliding in the receiving space 35 of the corresponding one of the horizontal members 3.

Figure 6:
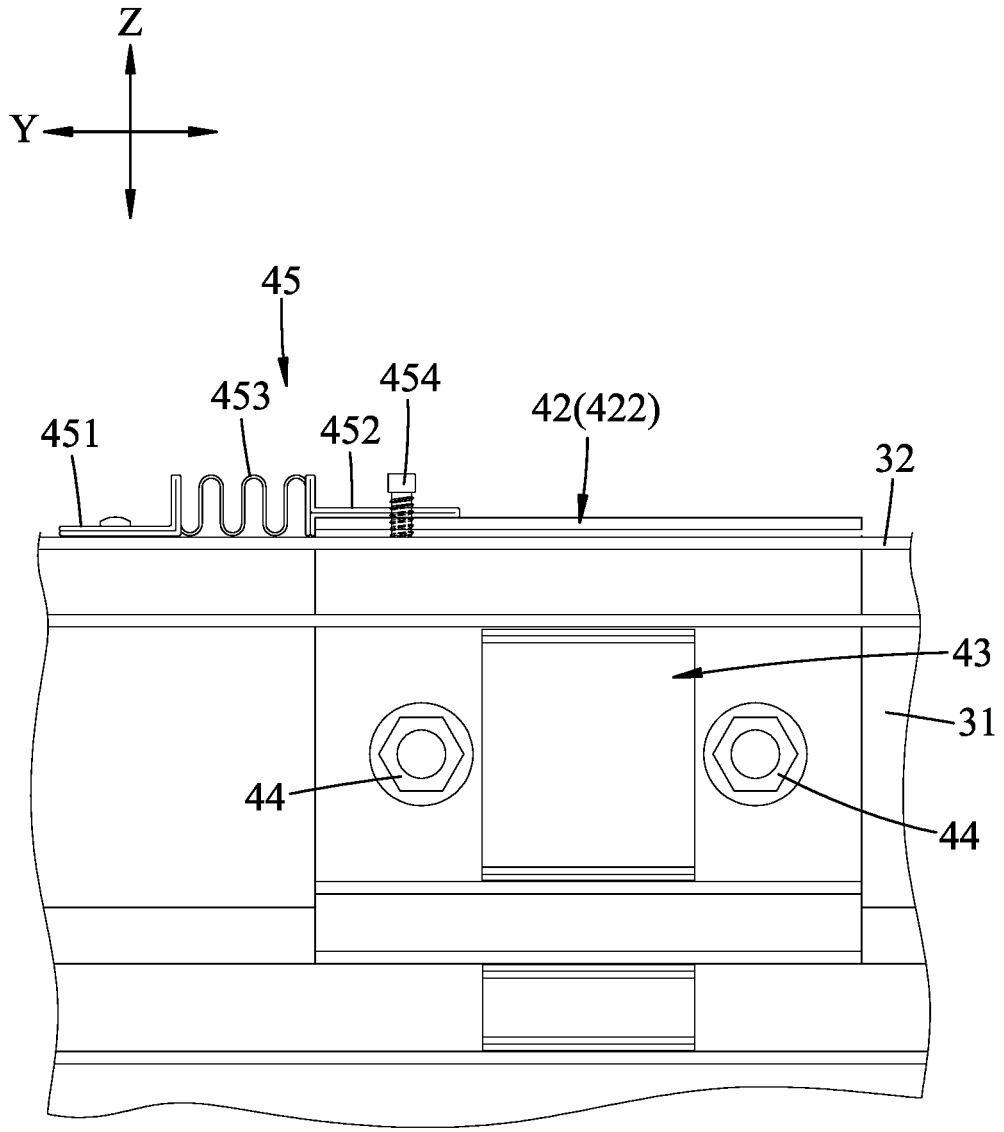
FIG. 6 is a fragmentary schematic view of the embodiment, illustrating the hanging member, the resilient member, the buffer ember, fastener members, and the horizontal member in an assembled state.

Referring to FIGS. 4 and 6, for each of the panel modules 4, left and right sides of each of the resilient members 43 are respectively adjacent to the through holes 427 of the respective one of the hanging members 42. Two of the fastener members 44 flank and are adjacent to a respective one of the resilient member 43, extend through the through holes 427 of a respective one of the hanging members 42 to which the respective one of the resilient member 43 is coupled, and are threadedly engaged with the building panel 41. As a result, each of the resilient members 43 is limited by two of the fastener members 44.

In other embodiments, the number of the through holes 427 of each of the hanging members 42 may be only one so that one fastener member 44 extends through a respective one of the resilient members 43 and the through hole 427 of a respective one of the hanging members 42, and is threadedly engaged with the building panel 41.

Referring to FIGS. 3, 4 and 6, for each of the panel members 4, each of the buffer members 45 has a fixed end portion 451, a movable end portion 452, a buffer portion 453, and an adjustment member 454. The fixed end portion 451 is fixed to the top protrusion 32 of the corresponding one of the horizontal members 3. The movable end portion 452 is opposite to the fixed end portion 451 in the left-right direction (Y) and is fixed to the top plate 422 of a respective one of the hanging members 42. The buffer portion 453 is resiliently connected between the fixed end portion 451 and the moving end portion 452. The adjustment member 454 is threadedly connected to the movable end portion 452 and the top plate 42 of the respective one of the hanging members 42, and abuts against the top protrusion 32 of the corresponding one of the horizontal members 3. Regarding the panel member 4 as shown in FIG. 3, when the building panel 41 is subjected to an external force in the left-right direction (Y), the buffer portions 453 of the buffer members 45 may absorb the external force to mitigate adverse effects of the external force. Additionally, by rotating the adjustment members 454 of the buffer members 45, the top plates 422 of the hanging members 42 may be moved away from or toward the top protrusion 32 of the corresponding one of the horizontal members 3 in the top-bottom direction (Z), thereby moving the building panel 41 upwardly or downwardly so as to fine tune a position of the building panel 41 in the top-bottom direction (Z).

Referring to FIGS. 1 and 5, the panel modules 4 are arranged in arrays and are hung on the horizontal members 3. The building panels 41 of the panel modules 4 are juxtaposed to each other and cooperatively form a panel wall 411 that is spaced apart from the wall 1 so that an air flow channel 412 is formed between the panel wall 411 and the wall 1, and communicates with an external space for air flowing. In this embodiment, a distance between the panel wall 411 and the wall 1 is 7.5 cm. As shown in FIG. 5, a gap between two juxtaposed ones of the building panels 41 is filled with silicone, thereby preventing air from circulating between the gap and the air flow channel 412.

Figure 7:
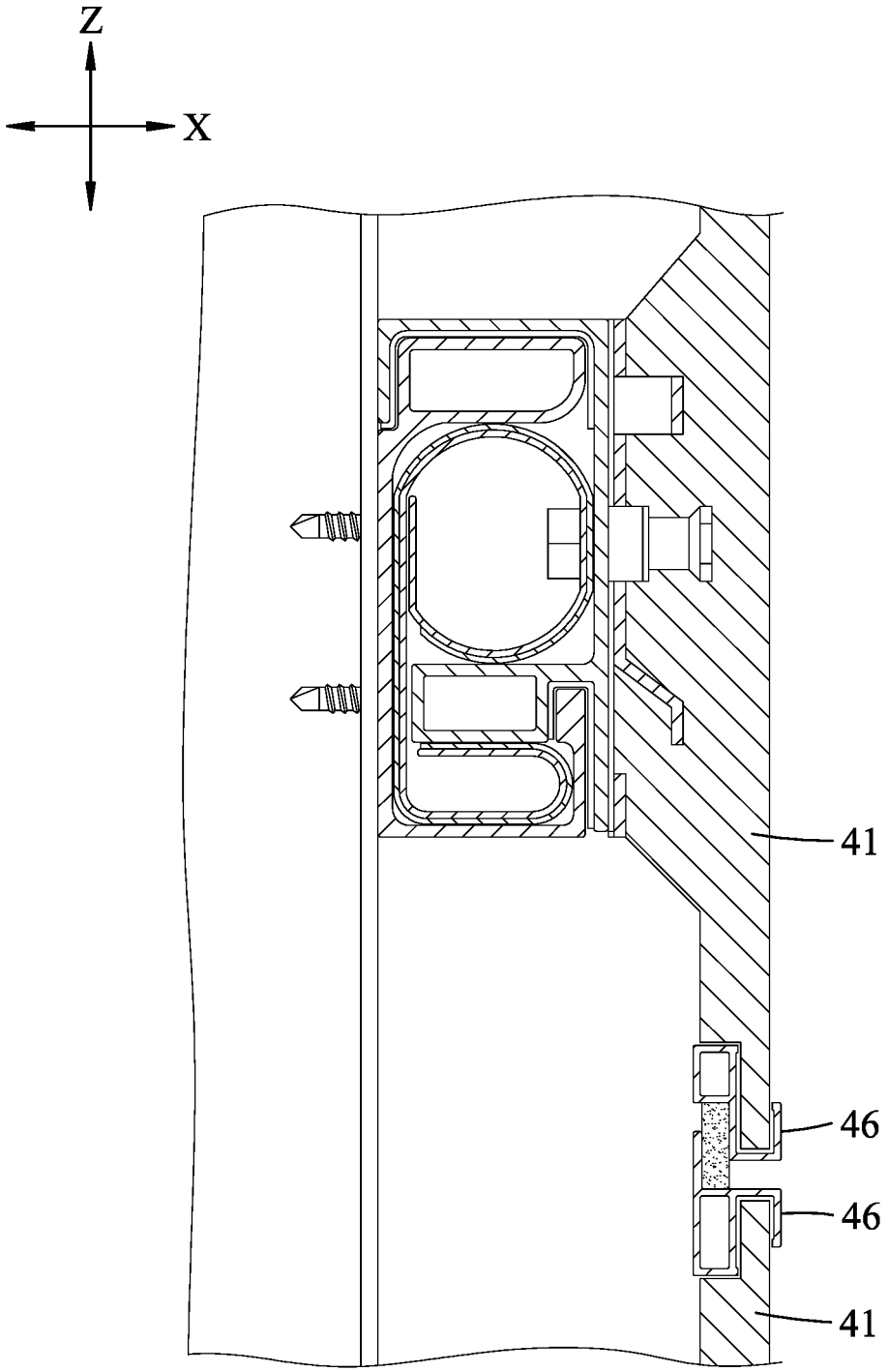
FIG. 7 is a sectional side view of the embodiment, illustrating hem members disposed around outer peripheries of building panels of the building panel system.

In other embodiments, as shown in FIG. 7, in addition to using silicone to fill the gap between the two juxtaposed building panels 41, each of the panel modules 4 may further have a hem member 46 that is disposed around an outer periphery of the building panel 41. A gap between the hem members 46 of two juxtaposed ones of the panel modules 4 may also be filled with silicone so as to enhance the connection strength between the two juxtaposed panels 41. The hem member 46 may be made of stainless steel or aluminum.

Figure 8:
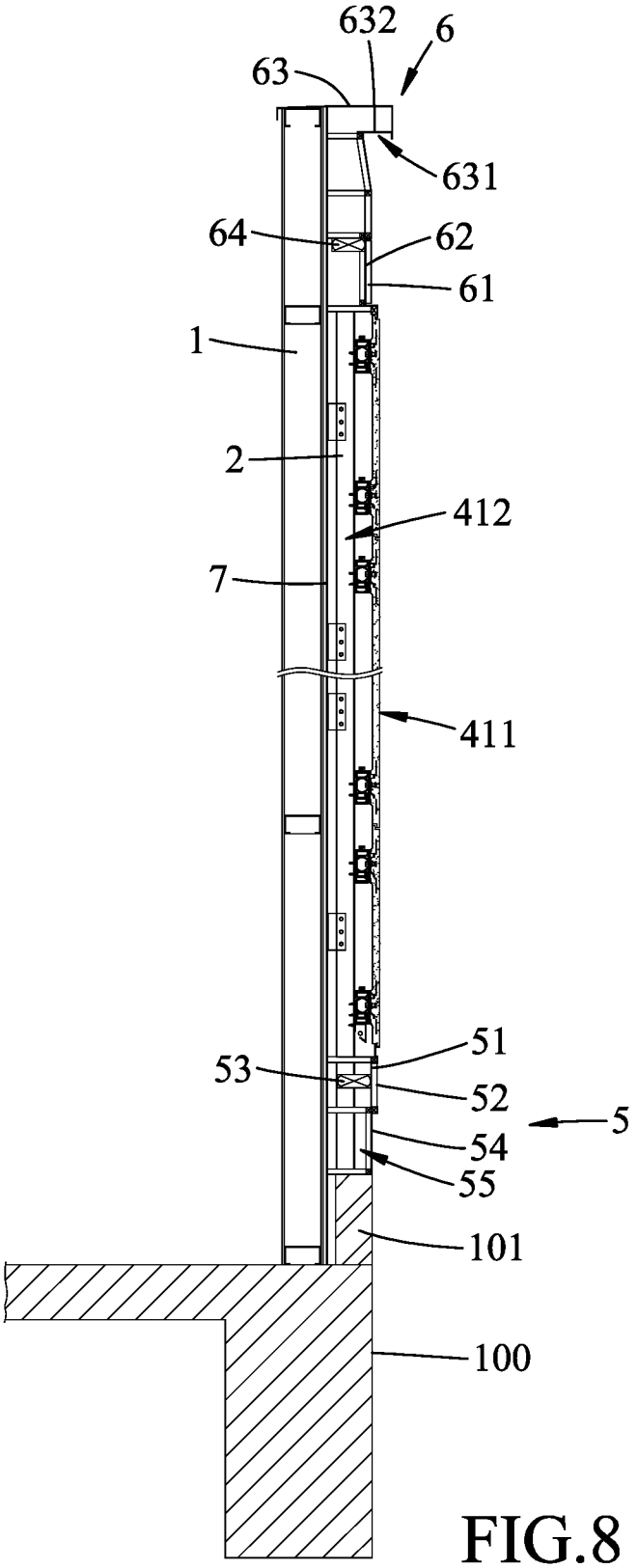
FIG. 8 is a partly fragmentary sectional side view of the embodiment.

Referring to FIG. 8, the building panel system of the disclosure further comprises an air intake module 5 and an air exhaust module 6.

The air intake module 5 has a bottom lateral plate 51, a solar plate 52, a plurality of air intake fans 53, and an air intake hole 55. The bottom lateral plate 51 is connected to a bottom end of the panel wall 411 and bounds a bottom end of the air flow channel 412. The solar plate 52 is disposed on an outside of the bottom lateral plate 51. The intake fans 53 (only one is shown) are connected to the bottom lateral plate 51, are powered by the solar plate 52, and are disposed within the bottom end of the air flow channel 412. The air intake hole 55 is formed between the bottom lateral plate 51 and a ground surface 100, and communicates with the bottom end of the air flow channel 412. In this embodiment, the air intake fans 53 are adapted to suck external air outside the air flow channel 412 into the air flow channel 412 through the air intake hole 55. The air intake module 5 further has an insect screen 54 that is disposed in front of the air intake hole 55 to prevent foreign objects or insects from entering the air intake hole 55. It should be noted that in other embodiments, the solar plate 52 may be disposed on a roof of a building (not shown) as long as it supplies power to the intake fans 53.

The air exhaust module 6 has a solar plate 61, a top lateral plate 62, a top cover plate 63, and a plurality of air exhaust fans 64. The solar plate 61 is connected to a top end of the panel wall 411. The top lateral plate 62 is connected to the top end of the panel wall 41 and is connected to a rear side of the solar plate 61, and extends upwardly relative to the panel wall 411. The top cover plate 63 is disposed on a top end of the top lateral plate 62 and cooperates with the top lateral plates 62 to bound a top end of the air flow channel 412. The air exhaust fans 64 (only one is shown) are connected to a rear side of the top lateral plate 62 and are disposed inside the top end of the air flow channel 412. The top cover plate 63 has an air exhaust hole 631 that communicates with the top end of the air flow channel 412 and that communicates with the external space. An insect screen 632 is disposed on the air exhaust hole 631, thereby preventing insects or foreign objects from entering the air flow channel 412. The air exhaust fans 64 are operable for discharging air inside the air flow channel 412 to the external space through the air exhaust hole 631. The bottom lateral plate 51, the top lateral plate 62, and the top cover plate 63 are made of a stainless steel material. It should be noted that in other embodiments, the solar plate 61 may be disposed on a roof of a building (not shown) as long as it supplies power to the air exhaust fans 64.

When the air intake fans 53 are operated to suck the external air outside the air flow channel 412 into the air flow channel 412, the sucked external air in the air flow channel 412 carries heat absorbed by the wall 1 and the panel wall 11. Subsequently, the air exhaust fans 64 are operated to discharge the sucked external air with the carried heat from the air flow channel 412.

The building panel system of the disclosure further includes an aluminum bubble foil 7 that is attached to the wall 1 to reflect heat radiation, thereby reducing heat absorption of the wall 1.

To assemble the building panel system, the aluminum bubble foil 7 is first attached to the wall 1. Sequentially, the vertical members 2 are mounted to the wall 1, and the horizontal members 3 are mounted to the vertical members 2. Subsequently, the panel modules 4 are hung on the horizontal members 3, and the gap between two juxtaposed ones of the building panels 41 is filled with silicone. After the panel wall 411 is formed by the building panels 41, the air intake module 5 is disposed below the panel wall 411, and the air exhaust module 6 is disposed above the panel wall 411. Assembling the building panel system of the disclosure is relatively convenient and easy, thereby shortening assembly period and requiring less manpower. Therefore, labor and material costs may be reduced.

In summary, by virtue of the panel wall 411 being formed by the building panels 41, the building panel system of the disclosure may effectively prevent sunlight from directly hitting the wall 1. Besides, the air flow channel 412 for air flowing may effectively block heat transmission. Furthermore, by virtue of the air intake module 5 sucking the external air into the air flow channel 412 to absorb heat, and by virtue of the air exhaust module 6 discharging the heat-absorbed air from the air flow channel 412, the building panel system may facilitate heat dissipation. In addition, the aluminum bubble foil 7 attached to the wall 1 may also reduce heat absorption by the wall 1, and therefore the purpose of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest Interpretation so as to encompass all such modifications and equivalent arrangements.

What is claimed is:

1. A building panel system adapted for mounting to a building wall, said building panel system comprising:

a plurality of vertical members that are spaced apart from each other in a left-right direction, and that extend in a top-bottom direction perpendicular to the left-right direction;

a plurality of horizontal members that are spaced apart from each other in the top-bottom direction, that are mounted to said vertical members, and that extend in the left-right direction, each of said horizontal members includes a rear base plate that abuts against said vertical members, and a top protrusion that protrudes from a top end of said rear base plate in a front-rear direction perpendicular to the left-right and top-bottom directions and that is spaced apart from and disposed forwardly of said vertical members, said top protrusion and said rear base plate cooperatively defining a positioning recess therebetween;

a bottom plate that extends forwardly from a bottom end of said rear base plate, and a front blocking plate that extends upwardly from an end of said bottom plate opposite to said rear base plate; and a plurality of panel modules, each of said panel modules including a building panel, and at least one hanging member that is connected to said building panel and that is hung on a corresponding one of said vertical members and said horizontal members, and for each of said panel modules, said at least one hanging member is hung on a corresponding one of said horizontal members and includes a front base plate that is connected to said building panel, a top plate that extends rearwardly from a top end of said front base plate, and an insertion plate that extends downwardly from an end of said top plate opposite to said front base plate and that is engaged with said positioning recess of the one of said horizontal members;

wherein said building panels of said panel modules cooperatively form a panel wall configured to be spaced apart from the building wall so that an air flow channel is formed between said panel wall and the building wall and is configured to communicate with an external space for air flowing.

2. The building panel system as claimed in claim 1, wherein each of said panel modules further includes a buffer member that has a fixed end portion fixed to said top protrusion of the corresponding one of said horizontal members;

a movable end portion opposite to said fixed end portion in the left-right direction and fixed to said top plate of said at least one hanging member;

a buffer portion resiliently connected between said fixed end portion and said moving end portion; and an adjustment member threadedly connected to said movable end portion and said top plate of said at least one hanging member, and abutting against said top protrusion of the corresponding one of said horizontal members.

3. The building panel system as claimed in claim 1, wherein:

said building panel system further comprises an air intake module that has a bottom lateral plate connected to a bottom end of said panel wall and bounding a bottom end of said air flow channel, a plurality of air intake fans connected to said bottom lateral plate and disposed within said bottom end of said air flow channel, and an air intake hole adapted to be formed between said bottom lateral plate and a ground surface, and communicating with said bottom end of said air flow channel; and said air intake fans are adapted to suck external air outside said air flow channel into said air flow channel through said air intake hole.

4. The building panel system as claimed in claim 1, wherein:

said building panel system further comprises an air exhaust module that has a top lateral plate connected to a top end of said panel wall, a top cover plate disposed on a top end of said top lateral plate and cooperating with said top lateral plates to bound a top end of said air flow channel, and a plurality of air exhaust fans connected to said top lateral plate and disposed inside said top end of said air flow channel;

said top cover plate has an air exhaust hole that communicates with said top end of said air flow channel and that is adapted to communicate with the external space; and said air exhaust fans are operable for discharging air inside said air flow channel to the external space through said air exhaust hole.

5. The building panel system as claimed in claim 1, further comprising an aluminum bubble foil that is configured to be disposed on the building wall to reflect heat radiation.

6. The building panel system as claimed in claim 1, wherein:

each of said horizontal members has a receiving space that opens forwardly;

for each of said panel modules, said at least one hanging member is hung on a corresponding one of said horizontal members; and each of said panel modules further includes at least one resilient member that is received in said receiving space of the corresponding one of said horizontal members and that is coupled to said at least one hanging member.

7. The building panel system as claimed in claim 6, wherein:

said at least one hanging member of each of said panel modules has two through holes that are spaced apart from each other;

each of said panel modules further includes two fastener members that flank and are adjacent to said at least one resilient member, that extend through said through holes, and that are threadedly engaged with said building panel.

8. The building panel system as claimed in claim 1, wherein:

for each of said horizontal members, said rear base plate, said top protrusion, said bottom plate, and said front blocking plate cooperatively define a receiving space that opens forwardly;

for each of said panel modules, said at least one hanging member further includes a partition plate that extends rearwardly from said front base plate and that extends into said receiving space of the corresponding one of said horizontal members, and a bottom protrusion that extends downwardly from said partition plate and that is spaced apart from said front base plate; and said partition plate, said bottom protrusion, and said front base plate cooperatively define an engaging recess that opens downwardly and that is engaged with said front blocking plate of the corresponding one of said horizontal members.

9. The building panel system as claimed in claim 8, wherein:

each of said panel modules further includes at least one resilient member that is received in said receiving space of the corresponding one of said horizontal members and that is coupled to said at least one hanging member; and said at least one resilient member has a rear support portion that abuts against said rear base plate of the corresponding one of said horizontal members, a top abutting portion that is connected to a top of said rear support portion and that resiliently abuts against said top protrusion of the corresponding one of said horizontal members, a front support portion that is connected to said top abutting portion and that resiliently abuts against said front base plate of said at least one hanging member, a first abutting arm portion that is connected to said front support portion and that resiliently abuts against said partition plate of said at least one hanging member, a bottom abutting portion that is connected to a bottom end of said rear support portion and that resiliently abuts against said bottom plate of the corresponding one of said horizontal members, and a second abutting arm portion that is connected to said bottom abutting portion and that resiliently abuts against said bottom protrusion of said at least one hanging member.

* * * * *